United States Patent [19]

Yamato et al.

[11] Patent Number: 4,480,260

[45] Date of Patent: Oct. 30, 1984

[54] COLOR-DEVELOPING SHEET FOR PRESSURE-SENSITIVE RECORDING SHEETS

[75] Inventors: Noboru Yamato; Akira Hasegawa; Hiroaki Umeda; Mamoru Suzuki, all of Tokyo, Japan

[73] Assignee: Jujo Paper Co., Ltd., Tokyo, Japan

[21] Appl. No.: 452,281

[22] Filed: Dec. 22, 1982

[30] Foreign Application Priority Data

Dec. 24, 1981 [JP] Japan ..... 56-208149

[51] Int. Cl.[3] ..... B41M 5/22

[52] U.S. Cl. ..... 346/209; 346/212; 346/216; 346/217; 346/221; 346/225

[58] Field of Search ..... 282/27.5; 427/150, 151; 428/320.4, 320.6, 320.8, 411, 488, 537, 914

[56] References Cited

U.S. PATENT DOCUMENTS

| | | | |
|---|---|---|---|
| 4,408,781 | 10/1983 | Watanabe | 282/27.5 |
| 4,421,344 | 12/1983 | Ikezawa et al. | 282/27.5 |

FOREIGN PATENT DOCUMENTS

| | | | |
|---|---|---|---|
| 42910 | 4/1978 | Japan | 346/225 |
| 108706 | 8/1979 | Japan | 346/212 |
| 37189 | 4/1981 | Japan | 346/212 |

*Primary Examiner*—Bruce H. Hess

*Attorney, Agent, or Firm*—Koda and Androlia

[57] ABSTRACT

A color-developing sheet for pressure-sensitive recording sheets having a color-developing layer on the base sheet wherein the color-developing layer includes 3 to 20 parts by weight of zinc carbonate, 1 to 30 parts by weight of thiourea compound and 0.1 to 5 parts by weight of bisphenol per 100 parts by weight of activated clay.

5 Claims, No Drawings

COLOR-DEVELOPING SHEET FOR PRESSURE-SENSITIVE RECORDING SHEETS

BACKGROUND OF THE INVENTION

1. Field of the Invention

This invention relates to pressure-sensitive recording sheets and more particularly to pressure-sensitive developing sheets which can provide recorded color images having a high color intensity and excellent light fastness.

2. Prior Art

Generally, pressure-sensitive recording sheets are composed of a top sheet coated on its backside with microcapsules containing electron-donating colorless or light-colored color-forming dyes dissolved in an organic solvent (capsule oil) and an under sheet having, on its front side, a developing agent layer containing electron-accepting developing agents. These two sheets are laid so that the two coated surfaces face each other and arranged so that printed records are produced in such a way that when pressure is applied with a ball-point pen or typewriter, the capsules in the pressed area are ruptured and the emerged capsule oil containing color-forming dyes is transferred to the developing layer and brings about a color-forming reaction. Moreover, a plurality of copies can be obtained by using intermediate sheets wherein each of which has a developing layer on its front side and microcapsules on its back side, sandwiched between the top and under sheets. Accordingly, the developing sheets of this invention include intermediate sheets in addition to the above-mentioned under sheet.

The developing agents which are conventionally known include inorganic solid acids such as activated clay (for example, Japanese Patent Publication No. 7622/1966), attapulgite (for example, U.S. Pat. No. 2,712,507), substituted phenols and diphenols (for example, Japanese Patent Publication No. 9309/1965), p-substituted phenol/formaldehyde polymers (for example, Japanese Patent Publication 20144/1967), aromatic carboxylic acid metal salts (for example, Japanese Patent Publication No. 10856/1974), and 2,2'-bisphenol sulfone compounds (for example, Japanese Patent Laid-Open No. 106313/1979).

Of these developing agents, activated clay is prepared by treating Japanese acid clay or like clay with a mineral acid to elute iron or other basic components and increase the specific surface area. Activated clay having a specific surface area of not less than 200 $m^2/g$ is thought to have a particularly excellent developing effect. Such activated clay is advantageous in that it is very inexpensive as compared with the cost of the other above described organic developing agents.

With respect to the color of the developed color image of a pressure-sensitive recording sheet, blue color-forming recording sheets prepared by using, as a developing agent, Crystal Violet Lactone (CVL), Benzoyl Leuco Methylene Blue (BLMB) or the like were initially used. However, as demands of the market for black color-forming recording sheets grew greater, a method comprising mixing at least two dyes having different developed colors has been adopted in order to produce black color recorded images, as disclosed, for example, in Japanese Patent Publication Nos. 4698/1970 and 4614/1971. For example, black color-forming dyes can be obtained by combining dyes having developed colors which are in a relationship of complementary colors or which constitute primary colors, such as blue/yellowish orange, blue/yellow/yellowish orange/red and blue/green/red.

This system is chiefly applied to pressure-sensitive. manifold sheets in which an inorganic solid acid such as activated clay or attapulgite is used. However, because the dyes have different rates of color formation and different fastness to light, temperature or moisture, they have a drawback that the developed color changes with the lapse of time when the images are further exposed to sunlight or ultraviolet rays during the period from the initial color formation to the final color formation or when they are stored for a long time. Furthermore, the following problems are frequently encountered: the color mixing and matching requires much time; because many kinds of dyes are used in quantity, the cost becomes expensive and the dissolution of dyes in solvent (capsule oil) is difficult.

In order to eliminate these drawbacks, fluoran dyes which can form a black color by themselves have been developed.

Exemplary of these dyes are 3-diethylamino-6-methyl-7-anilinofluoran, 3-(N-cyclohexyl-N-methyl-amino)-6-methyl-7-anilonofluoran, 3-diethylamino-6-methyl-7-(o,p-dimethylanilino)fluoran and 3-(N-ethyl-p-toluidino)-6-methyl-7-anilinofluoran. These dyes have an advantage that when an organic developing agent such as p-substituted phenol/formaldehyde polymer, aromatic carboxylic acid metal salt or 2,2'-bisphenol sulfone compound metal salt is used as a developing agent, the above dyes alone or in combination with a small amount of blue, red or like color dyes acting as complementary color dye can produce black developed color images whose color changes little with the lapse of time.

On the other hand, these dyes have disadvantages in that when they are used in combination with an inorganic developing agent such activated clay, the developed image shows reddish black or greenish black color, and the images when exposed to sunlight or ultraviolet rays, discolor or fade to reddish brown, so that developed color images with a stable color cannot be obtained.

Accordingly, although activated clay is inexpensive and has a superior developing performance as compared with organic developing agents, there has been no choice but to adopt the above-described mixed dye system in order to obtain a black color with a clay type developer.

SUMMARY OF THE INVENTION

As a result of comprehensive studies on developing sheets prepared from activated clay, the inventors of this invention have succeeded in developing sheets which, when used in combination with a sole black color-forming fluoran dye, form a pure black color and give a high-color density developed color images having excellent light fastness and less color change with the lapse of time and which, also in the case of blue color formation, provide excellent developing property, storage stability, light fastness, etc. In particular, these objects are accomplished utilizing a color developing sheet which includes a color developing layer which includes activated clay, a zinc carbonate, a thiourea compound selected from the group consisting of thiourea, trimethylthiourea, dimethylthiourea, dibutylthiourea, dilaurylthiourea, ethylenethiourea and diphenylthiourea, and a bisphenol compound.

DETAILED DESCRIPTION OF THE INVENTION

As the black color-forming dyes which can be used in this invention, there can be utilized 3-(N-ethyl-N-isoamly)amino-6-methyl-7-anilinofluoran, 3-pyrrolidino-6-methyl-7-anilinofluoran, 3-piperidino-6-methyl-7-anilinofluoran, 3-(N-cyclohexyl-N-methylamino)-6-methyl-7-anilinofluoran, 3-diethylamino-7-(m-trifluoromethylanilino)fluoran, 3-(N-ethyl-p-toluidino)-6-methyl-7-anilinofluoran, 3-(N-ethyl-p-toluidino)-6-methyl-7-(p-methylanilino) fluoran, 3-diethylamino-6-methyl-7-anilinofluoran, 3-diethylamino-6-methyl-7-(p-n-butylanilino)fluoran, 3-diethylamino-6-methyl-7-(o,m-dimethylanilino)fluoran, 3-diethylamino-6-methyl-7-(o,p-dimethylanilino)fluoran, 3-n-dibutylamino-6-methyl-7-(o-chloroanilino)fluoran, 3-diethylamino-7-(o-chloroanilino)fluoran, 3-diethylamino-7-cyclohexylanilinofluoran and 3-pyrrolidino-7-cycohexylanilinofluoran.

As the blue color-forming dyes which can be used in this invention, there can be utilized tri-phenylmethane phthalide dyes such as 3,3'-bis(diethyl-aminophenyl)-6-dimethylaminophthalide (Crystal Violet Lactone: CVL), phenothiazine dyes such as 3,7-bis(dimethylamino)-10-benzoylphenothiazine (Benzoyl Leuco Methylene Blue: BLMB) and phenoxazine dyes such as 3,7-bis(dimethylamino)-10-benzoylphenoxazine. These dyes can be used alone or in combination. In addition to the above dyes, red color-forming dyes, green color-forming dyes, etc., can also be used.

These dyes are dissolved in organic solvents and encapsulated by a method such a coacervation process (for example U.S. Pat. No. 2,800,457), interfacial polymerization (for example, Japanese Patent Publication No. 19578/1963) or in-situ polymerization (for example, Japanese Patent Publication No. 45133/1974). Then, the microcapusles are coated onto a base sheet to prepare a transfer sheet.

The developing sheet of this invention used in combination with the above transfer sheet is prepared by providing a developing layer containing activated clay, zinc carbonate thiourea compound and bisphenol compound on a base sheet. By using zinc carbonate, thiourea compound and bispenol compound in addition to activated clay onto the developing sheet, it is possible to obtain pure-black recorded color images having high color intensity through the application of the features of the above-described sole black color-forming fluoran dye; moreover, it brings markedly improved light fastness and stability of the developed color (these properties of the above-mentioned dyes were heretofore not satisfactory) and which, also in blue color formation, exhibits excellent color development, storage stability and light fastness.

In this invention, thiourea compound operates to obtain a pure-black color and further to improve light fastness and to reduce changes in the developed color. As the thiourea compound used in this invention, there can be utilized thiourea, trimethylthiourea, diethylthiourea, dibutylthiourea, dilaurylthiourea, ethylenethiourea and diphenylthiourea. Preferable among them are trimethylthiourea, diethylthiourea, dibutylthiourea, and diphenylthiourea.

The zinc carbonate having an advantageous effect to increase the color intensity and to improve resistance to light fading and color changing.

The bisphenol compounds also increase the color intensity and improve the light fastness remarkably, and this effect is marked particularly in the case of blue color formation. As examples of the bisphenol compounds, there can be mentioned 2,2'-bis(4'-hydroxyphenyl)-propane, 2,2'-bis(4'-hydroxyphenyl) butane, 2,2'-bis(3'-methyl-4'-hydroxyphenyl)propane, 1,1'-bis(4'-hydroxyphenyl)methane, 1,1'-bis(4'-hydroxyphenyl)ethane, 1,1'-bis(4'-hydroxyphenyl)butane, 1,1'-bis(4'-hydroxyphenyl)heptane, 2,2'-bis(3'-phenyl-4'-hydroxyphenyl)propane, 2,2'-bis(3'-diethyl-4'-hydroxyphenyl)propane, 2,2'-bis(3'-isopropyl-4'-hydroxyphenyl) propane and 2,2'-bis(3'-hydroxyphenyl)propane, and one or more of these compounds are used. Of these bisphenol compounds, 2,2'-bis(4'-hydroxyphenyl)propane (bisphenol A) and 2,2'-bis(4'-hydroxyphenyl)butane are most suitable.

Effects of combinative use of zinc carbonate, thiourea compound and bisphenol compound of this invention are prominent, so that when sole black color-forming fluoran dye is used, recorded images of pure-black color are obtained having high color intensity, excellent light fastness and less color changes and, at the same time, excellent color development, storage stability of images and excellent light fastness of images are obtained in the case of blue color formation.

As the binders used in the developing layer, there can be utilized natural or synthetic high-molecular substances such as starch, carboxymethylcellulose, methylcellulose, gelatin, gum arabic, polyvinyl alcohol, casein and styrene/butadiene copolymer latexes, and as inorganic pigment, there can be utilized natural or synthetic inorganic pigments such as clay, talc, kaolin, calcium carbonate, basic magnesium carbonate, barium sulfate, barium carbonate, aluminum hydroxide and zinc white.

The developing sheet of this invention preferably has a developing layer consisting of 100 parts by weight of activated clay, 3 to 20 parts by weight of zinc compound, 1 to 30 parts by weight of thiourea compound and 0.1 to 5 parts by weight of bisphenol compound and further containing 10 to 40 parts by weight of binder, per 100 parts by weight of total solid compounds. The coating solution usually has a pH in the range of about 7 to 10, but in view of fluidity and coatability, the solution preferably has the lowest possible pH. This invention has an advantage that a good blue color intensity can be obtained even at a low pH. The developing layer preferably has a coating weight of 3 to 10 g/cm$^2$.

This invention is illustrated below with reference to examples.

EXAMPLE 1

(blue color-forming transfer sheet)

Twenty (20) parts by weight of gelatin, iso-electric point pH 8, was dissolved in 160 parts by weight of water. In this solution was added and emulsified 80 parts by weight of solvent oil prepared by dissolving 3% of Crystal Violent Lactone (CVL) and 1% of Benzoyl Leuco Methylene Blue (BLMB) in alkylated naphthalene. To this emulsion were added a solution of 20 parts of gum arabic in 160 parts by weight of water and then 550 parts by weight of water. The agitation was continued. Then a 10% acetic acid solution was added dropwise to the mixture to adjust the pH to 4.4 and cause coacervation. Up to this point, the temperature of the mixture was 50° C. or higher.

After cooling the mixture to 10° C., 38 parts by weight of 37% formalin was added as a curing agent to the solution. The resulting mixture was agitated and then adjusted to a pH of 9 by adding a 20% aqueous solution of caustic soda.

A transfer sheet was prepared by coating on a base sheet (40 g/m$^2$) with the thus-produced microcapsules containing color-forming dye at a coated weight of 5 g/m$^2$.

(black color-forming transfer sheet)

A black color-forming transfer sheet was prepared in the same manner as in the prepartion of the blue color-forming transfer sheet except that the oil prepared by dissolving CVL and BLMB was replaced with 80 parts by weight of solvent oil prepared by dissolving 4% of 3-diethylamino-6-methyl-7-anilinofluoran.

(developing sheet)

In 300 parts by weight of water was added 1 part by weight of sodium pyrophosphate as a dispersant. To this solution was dispersed 100 parts by weight of activated clay and then further added 5 parts by weight of zinc carbonate. Next to this dispersion were added, with agitation, 15 parts by weight of diethylthiourea and 1 part by weight of 2,2'-bis(4'-hydroxyphenyl)propane (bisphenol A). The diethylthiourea and the bisphenol A had been finely ground by an attritor, sand grinder or the like. Next, to this mixture was added 60 parts by weight of a styrene/butadiene copolymer latex (solids 50%), and the resulting mixture was adjusted to a pH of 7 by adding an aqueous solution of caustic soda.

A developing sheet was prepared by coating on base sheet (40 g/m$^2$) with the thus-prepared coating at a coated weight of 7 g/m$^2$.

EXAMPLES 2 THROUGH 6

(transfer sheet)

The blue color-forming and black color-forming transfer sheets of Example 1 were used.

(developing sheet)

Similarly to Example 1, developing sheets were prepared by using various thiourea compounds, a zinc carbonate, bisphenol A and activated clay in various amounts shown in Table 1.

COMPARATIVE EXAMPLES 1 THROUGH 16

(transfer sheets)

The blue color-forming and black color-forming transfer sheets of Example 1 were used.

(developing sheets)

Similarly to Example 1, developing sheets, as shown in Table 1, devoid of at least one member selected from the group consisting of various thiourea compounds, zinc compound and bisphenol compound were prepared.

The color intensity, developed color, light fastness and color changes were measured according to the following methods by using both transfer sheets and developing sheets obtained in Examples 1 through 6 and Comparative Examples 1 through 16.

(1) Color intensity: A transfer sheet is laid upon a developing sheet, the sheets are typed to develop a color. After 24 hours, the reflectance is measured by use of a Hunter reflectometer (manufactured by Toyo Precision Machinery Co.) with an amber filter. Color intensity is expressed in terms of of a reflectance before color formation, $I_o$, and a reflectance after 24 hours from color formation, $I_l$.

$$\text{Color intensity} = \frac{I_0 - I_1}{I_0} \times 100(\%)$$

Higher % color intensity is so much the better.

(2) Developed color: The developed color on a developing sheet developed by the method of (1) is evaluated after 24 hours by visual observation.

(3) Light fastness: A developing sheet developed by the method of (1) is exposed to sunlight for 2 hours and evaluated for the degree of fading.

(4) Color change: A developing sheet developed by the method of (1) is exposed to sunlight for 2 hours and evaluated by visually observing changes of the developed color.

The test results are tabulated in Table 1.

As is apparent from Table 1, in Examples 1 through 6, the color intensity is high in both cases of black color formation and blue color formation, the developed colors are good and the light fastness and the color change resistance are excellent.

On the contrary, in all of the Comparative Examples but Comparative Example 8, the light fastness in the case of blue color formation is insufficient, and considerable color changes are recognized. Moreover, in Comparative Examples 1 through 8, the developed black colors are tinged with red, the light fastness is insufficient and considerable color changes are recognized. Accordingly, these sheets have little practical value.

TABLE 1

| Example or Comparative Example | Activated Clay Parts by Weight | Thiourea Compound (Parts by Weight) | Zinc Compound (Parts by Weight) | Bisphenol Compound (Bisphenol A) Parts by Weight | Other Inorganic Fillers (Parts by Weight) |
|---|---|---|---|---|---|
| Example 1 | 100 | Diethylthiourea (15) | Zinc carbonate (5) | 1 | — |
| Example 2 | 100 | Diethylthiourea (15) | Zinc carbonate (5) | 4 | — |
| Example 3 | 100 | Trimethylthiourea (20) | Zinc carbonate (10) | 1 | — |
| Example 4 | 100 | Diphenylthiourea (5) | Zinc carbonate (20) | 1 | — |
| Example 5 | 100 | Diphenylthiourea (15) | Zinc | 1 | — |

TABLE 1-continued

| | | | | | |
|---|---|---|---|---|---|
| | | | carbonate (5) | | |
| Example 6 | 100 | Dibutlythiourea (10) | Zinc carbonate (10) | 1 | — |
| Comparative Example 1 | 100 | — | — | — | — |
| Comparative Example 2 | 100 | — | — | — | Kaolin (25) |
| Comparative Example 3 | 100 | — | — | — | Calcium carbonate (25) |
| Comparative Example 4 | 100 | — | — | — | Magnesium carbonate (25) |
| Comparative Example 5 | 100 | — | Zinc carbonate (25) | — | — |
| Comparative Example 6 | 100 | — | Zinc hydroxide (25) | — | — |
| Comparative Example 7 | 100 | — | Zinc oxide (25) | — | — |
| Comparative Example 8 | 100 | — | — | 5 | — |
| Comparative Example 9 | 100 | Diethylthiourea (25) | — | — | — |
| Comparative Example 10 | 100 | Trimethylthiourea (25) | — | — | — |
| Comparative Example 11 | 100 | Diphenylthiourea (25) | — | — | — |
| Comparative Example 12 | 100 | Diethylthiourea (15) | Zinc carbonate (25) | — | — |
| Comparative Example 13 | 100 | Trimethylthiourea (20) | Zinc carbonate (10) | — | — |
| Comparative Example 14 | 100 | Diphenylthiourea (5) | Zinc carbonate (20) | — | — |
| Comparative Example 15 | 100 | Dibutylthiourea (10) | Zinc carbonate (10) | — | — |
| Comparative Example 16 | 100 | Diethylthiourea (20) | — | 5 | — |

| Example or Comparative Example | Blue Color Formation | | | | Black Color Formation | | | |
|---|---|---|---|---|---|---|---|---|
| | Color Intensity | Developed Color | Light Fastness | Color Change | Color Density | Developed Color | Light Fastness | Color Change |
| Example 1 | 41 | Blue | Good | Greenish blue | 42 | Black | Good | Black |
| Example 2 | 44 | Blue | Good | Greenish blue | 45 | Black | Good | Black |
| Example 3 | 40 | Blue | Good | Greenish blue | 41 | Black | Good | Black |
| Example 4 | 43 | Blue | Good | Greenish blue | 43 | Black | Good | Black |
| Example 5 | 40 | Blue | Good | Greenish blue | 40 | Black | Good | Black |
| Example 6 | 41 | Blue | Good | Greenish blue | 41 | Black | Good | Black |
| Comparative Example 1 | 31 | Blue | Poor | Bluish green | 46 | Reddish black | Poor | Reddish brown |
| Comparative Example 2 | 24 | Blue | Poor | Bluish green | 42 | Reddish black | Poor | Reddish brown |
| Comparative Example 3 | 23 | Blue | Poor | Bluish green | 39 | Reddish black | Poor | Reddish brown |
| Comparative Example 4 | 28 | Blue | Poor | Bluish green | 40 | Reddish black | Poor | Reddish brown |
| Comparative Example 5 | 40 | Blue | Slightly poor | Blue-green | 45 | Reddish black | Slightly poor | Dark brown |
| Comparative Example 6 | 38 | Blue | Slightly poor | Blue-green | 44 | Reddish black | Slightly poor | Dark brown |
| Comparative Exmaple 7 | 36 | Blue | Slightly poor | Blue-green | 43 | Reddish black | Slightly poor | Dark brown |
| Comparative Example 8 | 44 | Blue | Good | Greenish blue | 45 | Reddish black | Good | Reddish black |
| Comparative Example 9 | 20 | Blue | Poor | Bluish green | 36 | Black | Good | Black |
| Comparative Example 10 | 12 | Blue | Poor | Bluish green | 35 | Black | Good | Black |
| Comparative Example 11 | 15 | Blue | Poor | Bluish green | 36 | Black | Good | Black |
| Comparative Example 12 | 33 | Blue | Slightly poor | Blue-green | 39 | Black | Good | Black |
| Comparative Example 13 | 32 | Blue | Slightly poor | Blue-green | 38 | Black | Good | Black |
| Comparative Example 14 | 35 | Blue | Slightly poor | Blue-green | 40 | Black | Good | Black |
| Comparative Example 15 | 33 | Blue | Slightly poor | Blue-green | 38 | Black | Good | Black |
| Comparative | 31 | Blue | Slightly | Blue- | 38 | Black | Good | Black |

TABLE 1-continued

| | | |
|---|---|---|
| Example 16 | poor | green |

We claim:

1. A color-developing sheet for pressure-sensitive recording sheets having a color-developing layer on a base sheet, said color-developing layer comprising activated clay, zinc carbonate, thiourea compound selected from the group consisting of thiourea, trimethylthiourea, diethyl thiourea, dibutylthiourea, dilaurylthiourea, ethylenethiourea and diphenylthiourea and bisphenol compound.

2. A color-developing sheet according to claim 1, wherein said thiourea compound is at least one member selected from the group consisting of trimethylthiourea, diethylthiourea, dibutylthiourea and diphenylthiourea.

3. A color-developing sheet according to claim 1, wherein said color-developing layer comprises 3 to 20 parts by weight of zinc carbonate, 1 to 30 parts by weight of thiourea compound and 0.1 to 5 parts by weight of bisphenol compound per 100 parts by weight of activated clay.

4. Color-developing sheet according to claim 1, wherein said bisphenol compound is at least one member selected from the group consisting of 2,2'-bis(4'-hydroxyphenyl)propane, 2,2'-bis(4'-hydroxyphenyl) butane, 2-2'-bis(3'-methyl-4'-hydroxyphenyl)propane, 1,1'-bis(4'-hydroxyphenyl) methane, 1,1'-bis(4'-hydroxyphenyl)-ethane, 1,1'-bis(4'hydroxphenyl) butane, 1,1'-bis(4'-hydroxyphenyl)heptane, 2,2'-bis(3'-phenyl4'-hydroxyphenyl)propane, 2,2'-bis(3'-diethyl-4'-hydroxphenyl) propane, 2,2'-bis(3'-isoprophyl-4'-hydroxyphenyl)propane and 2,2'-bis(3'-cyclohexyl-4'hydroxyphenyl)propane.

5. Color-developing sheet according to claim 1, wherein said color-developing layer has a coated weight of 3 to 10 g/cm$^2$.

* * * * *